US010465954B2

(12) United States Patent
Doepker et al.

(10) Patent No.: US 10,465,954 B2
(45) Date of Patent: Nov. 5, 2019

(54) CO-ROTATING COMPRESSOR WITH MULTIPLE COMPRESSION MECHANISMS AND SYSTEM HAVING SAME

(71) Applicant: Emerson Climate Technologies, Inc., Sidney, OH (US)

(72) Inventors: Roy J. Doepker, Lima, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 279 days.

(21) Appl. No.: 15/425,319

(22) Filed: Feb. 6, 2017

(65) Prior Publication Data

US 2018/0224171 A1 Aug. 9, 2018

(51) Int. Cl.
*F25B 31/02* (2006.01)
*F04C 23/00* (2006.01)
(Continued)

(52) U.S. Cl.
CPC ..... *F25B 31/026* (2013.01); *F04C 18/023* (2013.01); *F04C 23/001* (2013.01);
(Continued)

(58) Field of Classification Search
CPC ..... F25B 31/026; F25B 1/04; F04C 23/008; F04C 23/001; F04C 23/005;
(Continued)

(56) References Cited

U.S. PATENT DOCUMENTS 4,105,374 A 8/1978 Scharf
4,781,550 A 11/1988 Morishita et al.
(Continued)

FOREIGN PATENT DOCUMENTS

CN 103807166 A 5/2014
CN 105971880 A 9/2016
(Continued)

OTHER PUBLICATIONS

Translation of JPH 02140477.*
(Continued)

*Primary Examiner* — Elizabeth J Martin
(74) *Attorney, Agent, or Firm* — Harness, Dickey & Pierce, P.L.C.

(57) ABSTRACT

A compressor may include a shell, first and second compression mechanisms, first and second motor assemblies, first and second suction inlet fittings, and first and second discharge outlet fittings. The first and second compression mechanisms are disposed within the shell. The first and second motor assemblies are disposed within the shell and drive the first and second compression mechanisms, respectively. The first and second motor assemblies are operable independently of each other. The first suction inlet fitting may be attached to the shell and provides fluid to the first compression mechanism. The first discharge outlet fitting may be attached to the shell and receives fluid compressed by the first compression mechanism. The second suction inlet fitting may be attached to the shell and provides fluid to the second compression mechanism. The second discharge outlet fitting may be attached to the shell and receives fluid compressed by the second compression mechanism.

18 Claims, 5 Drawing Sheets

(51) Int. Cl.

| | |
|---|---|
| ***F04C 29/00*** | (2006.01) |
| ***F04C 18/02*** | (2006.01) |
| ***F25B 5/02*** | (2006.01) |
| ***F25B 7/00*** | (2006.01) |
| ***F04C 29/02*** | (2006.01) |
| ***F25B 1/04*** | (2006.01) |
| ***F04C 29/12*** | (2006.01) |
| ***F04C 27/00*** | (2006.01) |

(52) U.S. Cl.
CPC ..... *F04C 23/008* (2013.01); *F04C 29/0085* (2013.01); *F04C 29/02* (2013.01); *F25B 1/04* (2013.01); *F25B 5/02* (2013.01); *F25B 7/00* (2013.01); *F04C 27/001* (2013.01); *F04C 29/12* (2013.01); *F04C 2210/245* (2013.01); *F04C 2240/30* (2013.01); *F04C 2240/40* (2013.01); *F04C 2240/50* (2013.01); *F04C 2240/809* (2013.01); *F25B 2341/0661* (2013.01); *F25B 2400/06* (2013.01)

(58) Field of Classification Search
CPC ..... F04C 2240/30; F04C 2240/402; F04B 17/03; F04B 23/021; F04B 41/02; F04B 41/06
See application file for complete search history.

(56) References Cited

U.S. PATENT DOCUMENTS

| | | | |
|---|---|---|---|
| 4,846,639 | A | 7/1989 | Morishita et al. |
| 5,073,093 | A | 12/1991 | Takagi et al. |
| 5,090,876 | A | 2/1992 | Hashizume et al. |
| 5,099,658 | A | 3/1992 | Utter et al. |
| 5,129,798 | A | 7/1992 | Crum et al. |
| 5,211,031 | A | 5/1993 | Murayama et al. |
| 5,256,042 | A | 10/1993 | McCullough et al. |
| 5,256,044 | A | 10/1993 | Nieter et al. |
| 5,713,731 | A | 2/1998 | Utter et al. |
| 5,791,883 | A | 8/1998 | Ban et al. |
| 6,359,357 | B1 | 3/2002 | Blumenstock |
| 6,616,430 | B2 | 9/2003 | Mori et al. |
| 6,712,589 | B2 | 3/2004 | Mori et al. |
| 7,201,567 | B2 | 4/2007 | Wiertz et al. |
| 7,344,367 | B2 | 3/2008 | Manole |
| 8,058,762 | B2 | 11/2011 | Asano |
| 8,179,016 | B2 | 5/2012 | Asano |
| 8,373,326 | B2 | 2/2013 | Enomoto et al. |
| 8,894,388 | B2 | 11/2014 | Lee et al. |
| 2002/0182094 | A1 | 12/2002 | Mori et al. |
| 2008/0087033 | A1 | 4/2008 | Bae et al. |
| 2009/0104060 | A1 | 4/2009 | Sato et al. |
| 2010/0164313 | A1 | 7/2010 | Langford et al. |
| 2010/0225195 | A1 | 9/2010 | Asano et al. |
| 2011/0002797 | A1 | 1/2011 | Takeuchi et al. |
| 2011/0038737 | A1 | 2/2011 | Conry et al. |
| 2012/0131945 | A1 | 5/2012 | Huang et al. |
| 2013/0181565 | A1 | 7/2013 | Petro et al. |
| 2014/0361651 | A1 | 12/2014 | Park et al. |
| 2016/0043602 | A1 | 2/2016 | Hosek et al. |
| 2018/0013336 | A1 | 1/2018 | Li |
| 2018/0080446 | A1* | 3/2018 | Choi ..... F04C 29/023 |
| 2018/0223842 | A1 | 8/2018 | Stover et al. |
| 2018/0223843 | A1 | 8/2018 | Doepker et al. |
| 2018/0223848 | A1 | 8/2018 | Doepker et al. |
| 2018/0223849 | A1 | 8/2018 | Doepker et al. |
| 2018/0363654 | A1 | 12/2018 | Doepker et al. |
| 2019/0186488 | A1 | 6/2019 | Stover et al. |

FOREIGN PATENT DOCUMENTS

| | | | |
|---|---|---|---|
| JP | H02140477 | A | 5/1990 |
| JP | H02207190 | A | 8/1990 |
| JP | H06213232 | A | 8/1994 |
| JP | H07229481 | A | 8/1995 |
| JP | 2004052657 | A | 2/2004 |
| JP | 2015004296 | A | 1/2015 |
| JP | 2015124653 | A | 7/2015 |
| KR | 1019910001253 | | 1/1991 |
| KR | 20150006278 | A | 1/2015 |
| KR | 20160091106 | A | 8/2016 |

OTHER PUBLICATIONS

Partial Search Report regarding European Patent Application No. 18155358.7, dated Jun. 27, 2018.
Search Report regarding European Patent Application No. 18155363.7, dated Jul. 2, 2018.
Search Report regarding European Patent Application No. 18155362.9, dated Jul. 2, 2018.
Office Action regarding U.S. Appl. No. 15/425,374, dated Jul. 27, 2018.
U.S. Appl. No. 15/114,912, filed Aug. 28, 2018, Roy J. Doepker et al.
Election/Restriction Requirement regarding U.S. Appl. No. 15/425,428, dated Aug. 8, 2018.
Office Action regarding U.S. Appl. No. 15/425,428, dated Nov. 1, 2018.
Notice of Allowance regarding U.S. Appl. No. 15/425,374, dated Nov. 7, 2018.
Office Action regarding U.S. Appl. No. 16/114,912, dated Dec. 3, 2018.
Notice of Allowance regarding U.S. Appl. No. 15/425,428, dated Feb. 15, 2019.
Office Action regarding Korean Patent Application No. 10-2018-0013623, dated Feb. 18, 2019. Translation provided by KS KORYO International IP Law Firm.
Frank, et al., NASA Tech Briefs, Ring Motors—Design Flexibility for Innovative Configurations, Sep. 1, 2014.
McMullen, et al., Combination Radial-Axial Magnetic Bearing, Seventh International Symp. on Magnetic Bearings, Aug. 23-25, 2000.
"Design of Electric Machines: Axial Flux Machines," Electric Energy Magazine No. 4, Jan.-Jun. 2013, 23 pages.
Mahmoudi, Rahim and Hew, "Axial-flux permanent-magnet machine modeling, design, simulation and analysis," Scientific Research and Essays vol. 6 (12), Jun. 18, 2011, pp. 2525-2549.
Office Action regarding U.S. Appl. No. 15/205,907, dated May 29, 2018.
International Search Report of the ISA regarding International Patent Application No. PCT/US2018/017069, dated Jun. 12, 2018.
Written Opinion of the ISA regarding International Patent Application No. PCT/US2018/017069, dated Jun. 12, 2018.
Office Action regarding Chinese Patent Application No. 201810116198.8, dated Feb. 26, 2019. Translation provided by Unitalen Attorneys at Law.
Office Action regarding Korean Patent Application No. 10-2018-0013620, dated Feb. 26, 2019. Translation provided by KS KORYO International IP Law Firm.
Office Action regarding Chinese Patent Application No. 201810119087.2, dated Feb. 27, 2019. Translation provided by Unitalen Attorneys at Law.
Office Action regarding Chinese Patent Application No. 201810118025.X, dated Mar. 4, 2019. Translation provided by Unitalen Attorneys at Law.
Office Action regarding Korean Patent Application No. 10-2018-0013622, dated Mar. 20, 2019. Translation provided by KS KORYO International IP Law Firm.
Office Action regarding Chinese Patent Application No. 201810119178.6, dated Mar. 21, 2019. Translation provided by Unitalen Attorneys at Law.
Office Action regarding Korean Patent Application No. 10-2018-0013621, dated Mar. 25, 2019. Translation provided by KS KORYO International IP Law Firm.
Office Action regarding U.S. Appl. No. 16/114,912, dated Mar. 28, 2019.

(56) References Cited

OTHER PUBLICATIONS

Office Action regarding Korean Patent Application No. 10-2018-0013620, dated May 28, 2019. Translation provided by KS KORYO International IP Law Firm.
Restriction Requirement regarding U.S. Appl. No. 15/425,266, dated May 28, 2019.
Notice of Allowance regarding U.S. Appl. No. 16/114,912, dated Jun. 10, 2019.
U.S. Appl. No. 15/425,266, filed Feb. 6, 2017.
U.S. Appl. No. 15/425,374, filed Feb. 6, 2017.
U.S. Appl. No. 15/425,428, filed Feb. 6, 2017.
U.S. Appl. No. 15/205,907, filed Jul. 8, 2016.
U.S. Appl. No. 15/877,870, filed Jan. 23, 2018, Roy J. Doepker et al.
U.S. Appl. No. 16/284,653, filed Feb. 25, 2019, Robert C. Stover et al.

* cited by examiner

CO-ROTATING COMPRESSOR WITH MULTIPLE COMPRESSION MECHANISMS AND SYSTEM HAVING SAME

FIELD

The present disclosure relates to a co-rotating compressor with multiple compression mechanisms and to a system including the co-rotating compressor.

BACKGROUND

This section provides background information related to the present disclosure and is not necessarily prior art.

A compressor may be used in a refrigeration, heat pump, HVAC, or chiller system (generically, "climate control system") to circulate a working fluid therethrough. The compressor may be one of a variety of compressor types. For example, the compressor may be a scroll compressor, a rotary-vane compressor, a reciprocating compressor, a centrifugal compressor, or an axial compressor. Some compressors include a motor assembly that rotates a driveshaft. In this regard, compressors often utilize a motor assembly that includes a stator surrounding a central rotor that is coupled to the driveshaft below the compression mechanism. Regardless of the exact type of compressor employed, consistent and reliable operation of the compressor is desirable to effectively and efficiently circulate the working fluid through the climate control system. The present disclosure provides an improved, compact compressor having multiple motor assemblies that efficiently and effectively drive multiple compression mechanisms. The present disclosure also provides systems that advantageously incorporate such a compressor.

SUMMARY

This section provides a general summary of the disclosure, and is not a comprehensive disclosure of its full scope or all of its features.

An aspect of the present disclosure provides a compressor that may include a shell (e.g., a shell assembly), a first compression mechanism, a first motor assembly, a second compression mechanism, a second motor assembly, a first suction inlet fitting, a first discharge outlet fitting, a second suction inlet fitting, and a second discharge outlet fitting. The first compression mechanism is disposed within the shell. The first motor assembly is disposed within the shell and drives the first compression mechanism. The second compression mechanism is disposed within the shell. The second motor assembly is disposed within the shell and drives the second compression mechanism. The first and second motor assemblies are operable independently of each other. The first suction inlet fitting may be attached to the shell and provides fluid to the first compression mechanism. The first discharge outlet fitting may be attached to the shell and receives fluid compressed by the first compression mechanism. The second suction inlet fitting may be attached to the shell and provides fluid to the second compression mechanism. The second discharge outlet fitting may be attached to the shell and receives fluid compressed by the second compression mechanism.

In some configurations, the first compression mechanism includes a first scroll member that is rotatable relative to the shell about a first rotational axis and a second scroll member that is rotatable relative to the shell about a second rotational axis that is parallel to and offset from the first rotational axis.

The second compression mechanism includes a third scroll member that is rotatable relative to the shell about a third rotational axis and a fourth scroll member that is rotatable relative to the shell about a fourth rotational axis that is parallel to and offset from the third rotational axis.

In some configurations, the first motor assembly includes a first rotor attached to the first scroll member and surrounds the first and second scroll members. The second motor assembly includes a second rotor attached to the third scroll member and surrounds the third and fourth scroll members.

In some configurations, the shell includes a partition defining a first suction chamber and a second discharge chamber. The first suction chamber is in fluid communication with the first suction inlet fitting. The second discharge chamber is in fluid communication with the second discharge outlet fitting.

In some configurations, the partition defines a first lubricant sump that provides lubricant to the first compression mechanism.

In some configurations, the compressor includes a first bearing housing, a second bearing housing, a third bearing housing, and a fourth bearing housing. The first bearing housing is disposed within the shell and may rotatably support a first hub of the first scroll member. The first bearing housing may cooperate with the shell to define a first discharge chamber that receives compressed fluid from the first compression mechanism and is in fluid communication with the first discharge outlet fitting. The second bearing housing may be disposed within the first suction chamber and may rotatably support a second hub of the second scroll member. The third bearing housing is disposed within the shell and may rotatably support a third hub of the third scroll member. The third bearing housing may cooperate with the partition to define the second discharge chamber. The third bearing housing may define a second suction chamber in fluid communication with the second suction inlet fitting. The fourth bearing housing may be disposed within the second suction chamber and may rotatably support a fourth hub of the fourth scroll member.

In some configurations, the first suction chamber is fluidly isolated from the second suction chamber. The first discharge chamber is fluidly isolated from the second discharge chamber.

In some configurations, the partition defines a first lubricant sump disposed within the first suction chamber and providing lubricant to the first compression mechanism. The shell may define a second lubricant sump disposed within the second suction chamber and may provide lubricant to the second compression mechanism.

In some configurations, the first and second rotors each include a radially extending portion that extends radially outward relative to the first rotational axis and an axially extending portion that extends parallel to the first rotational axis. The axially extending portion of the first rotor engages the first scroll member and surrounds the second scroll member. The axially extending portion of the second rotor engages the third scroll member and surrounds the fourth scroll member.

In some configurations, the compressor includes a first seal and a second seal. The first seal may engage the second scroll member and the radially extending portion of the first rotor. The second seal may engage the fourth scroll member and the radially extending portion of the second rotor. The radially extending portions of the first and second rotors may be disposed axially between end plates of the second and fourth scroll members.

Another aspect of the present disclosure provides a system (a climate-control system) that may include a first indoor heat exchanger, a first expansion device, and a compressor. The first expansion device may be in fluid communication with the first indoor heat exchanger. The compressor may circulate fluid between the first indoor heat exchanger and the first expansion device. The compressor may include a shell (e.g., a shell assembly), a first compression mechanism, a first motor assembly, a second compression mechanism, a first suction inlet fitting, a first discharge outlet fitting, a second suction inlet fitting, and a second discharge outlet fitting. The first compression mechanism is disposed within the shell. The first motor assembly is disposed within the shell and drives the first compression mechanism. The second compression mechanism is disposed within the shell. The second motor assembly is disposed within the shell and drives the second compression mechanism. The first and second motor assemblies are operable independently of each other. The first suction inlet fitting may be attached to the shell and may provide fluid to the first compression mechanism. The first discharge outlet fitting may be attached to the shell and may receive fluid compressed by the first compression mechanism. The second suction inlet fitting may be attached to the shell and may provide fluid to the second compression mechanism. The second discharge outlet fitting may be attached to the shell and may receive fluid compressed by the second compression mechanism.

In some configurations, the system may include a first outdoor heat exchanger in fluid communication with the first expansion device. The first compression mechanism may circulate the fluid between the first indoor heat exchanger and the first outdoor heat exchanger.

In some configurations, the system includes a second indoor heat exchanger in fluid communication with the second compression mechanism. The second indoor heat exchanger and the second compression mechanism may be fluidly isolated from the first compression mechanism, the first outdoor heat exchanger, the first expansion device, and the first indoor heat exchanger.

In some configurations, the system includes a dual-path heat exchanger including a first fluid path disposed upstream of the first compression mechanism and a second fluid path disposed downstream of the second compression mechanism. The first and second fluid paths are in a heat transfer relationship with each other and are fluidly isolated from each other.

In some configurations, the system includes a second outdoor heat exchanger and a second expansion device. The second outdoor heat exchanger is in fluid communication with the second indoor heat exchanger. The second expansion device is in fluid communication with the second outdoor heat exchanger and the second indoor heat exchanger. The second compression mechanism circulates fluid between the second indoor heat exchanger and the second outdoor heat exchanger.

In some configurations, the system includes a dual-path heat exchanger, an outdoor heat exchanger, a second indoor heat exchanger, a second expansion device, a third expansion device, and a secondary compressor. The dual-path heat exchanger includes a first fluid path and a second fluid path in a heat transfer relationship with each other and fluidly isolated from each other. The first fluid path in fluid communication with the first and second compression mechanisms, the first expansion device, and the first indoor heat exchanger. The outdoor heat exchanger may be in fluid communication with the second fluid path. The second indoor heat exchanger may be in fluid communication with the outdoor heat exchanger. The second expansion device may be disposed between and in fluid communication with the outdoor heat exchanger and the second indoor heat exchanger. The third expansion device may be disposed between and in fluid communication with the outdoor heat exchanger and the second fluid path. The secondary compressor may be in fluid communication with the outdoor heat exchanger, the second indoor heat exchanger, and the second fluid path.

In some configurations, the first compression mechanism includes a first scroll member that is rotatable relative to the shell about a first rotational axis and a second scroll member that is rotatable relative to the shell about a second rotational axis that is parallel to and offset from the first rotational axis. The second compression mechanism may include a third scroll member that is rotatable relative to the shell about a third rotational axis and a fourth scroll member that is rotatable relative to the shell about a fourth rotational axis that is parallel to and offset from the third rotational axis.

In some configurations, the first motor assembly includes a first rotor attached to the first scroll member and surrounds the first and second scroll members. The second motor assembly may include a second rotor attached to the third scroll member and surrounding the third and fourth scroll members.

In some configurations, the shell includes a partition defining a first suction chamber and a second discharge chamber. The first suction chamber may be in fluid communication with the first suction inlet fitting. The second discharge chamber may be in fluid communication with the second discharge outlet fitting.

In some configurations, the partition defines a first lubricant sump that provides lubricant to the first compression mechanism.

In some configurations, the compressor includes a first bearing housing, a second bearing housing, a third bearing housing, and a fourth bearing housing. The first bearing housing is disposed within the shell and may rotatably support a first hub of the first scroll member. The first bearing housing may cooperate with the shell to define a first discharge chamber that receives compressed fluid from the first compression mechanism and is in fluid communication with the first discharge outlet fitting. The second bearing housing may be disposed within the first suction chamber and may rotatably support a second hub of the second scroll member. The third bearing housing is disposed within the shell and may rotatably support a third hub of the third scroll member. The third bearing housing may cooperate with the partition to define the second discharge chamber. The third bearing housing may define a second suction chamber in fluid communication with the second suction inlet fitting. The fourth bearing housing may be disposed within the second suction chamber and may rotatably support a fourth hub of the fourth scroll member.

In some configurations, the first suction chamber is fluidly isolated from the second suction chamber. The first discharge chamber may be fluidly isolated from the second discharge chamber.

In some configurations, the partition defines a first lubricant sump disposed within the first suction chamber and providing lubricant to the first compression mechanism. The shell may define a second lubricant sump disposed within the second suction chamber and may provide lubricant to the second compression mechanism.

In some configurations, the first and second rotors each include a radially extending portion that extends radially outward relative to the first rotational axis and an axially extending portion that extends parallel to the first rotational axis. The axially extending portion of the first rotor may engage the first scroll member and may surround the second scroll member. The axially extending portion of the second rotor may engage the third scroll member and surround the fourth scroll member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
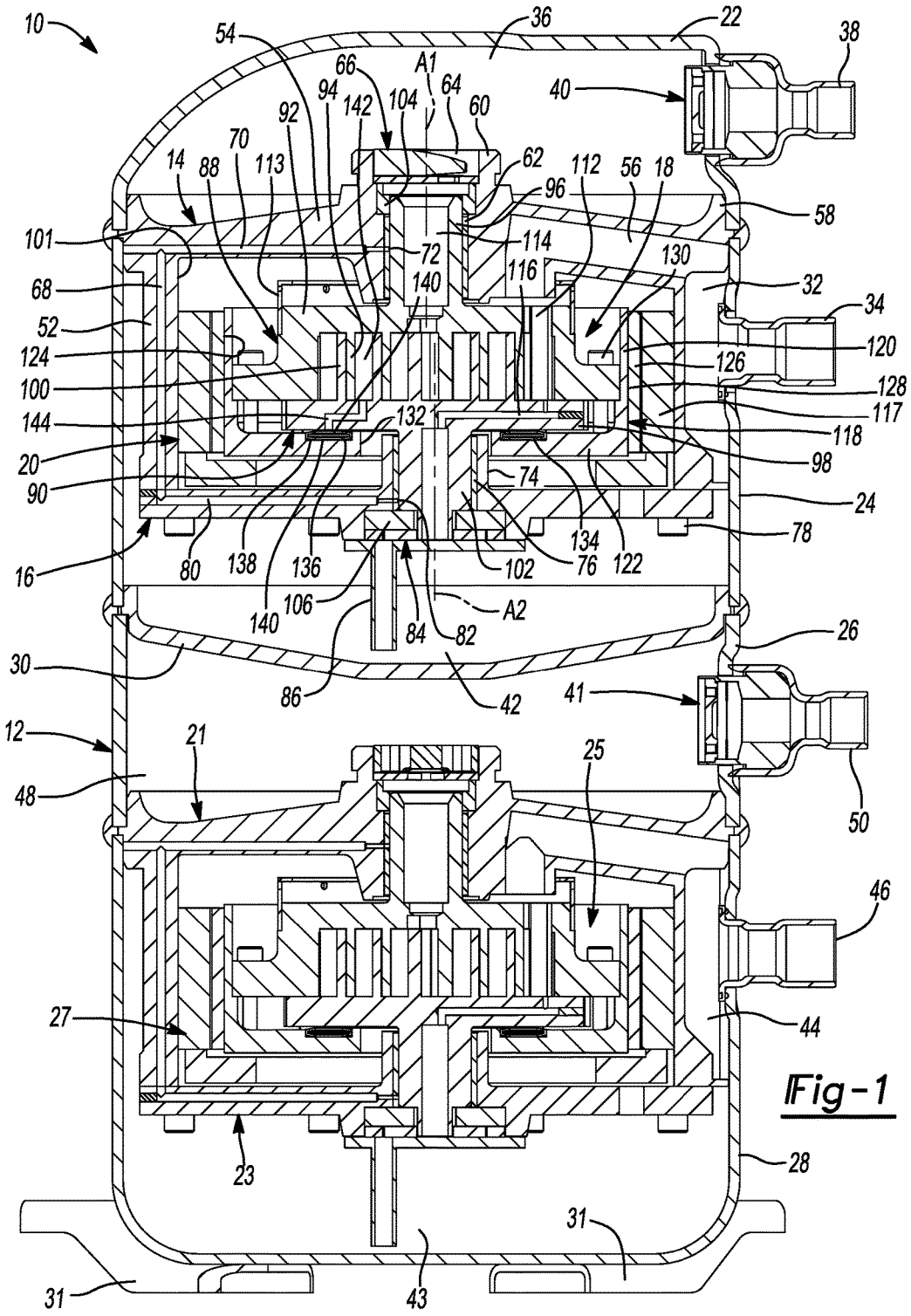
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
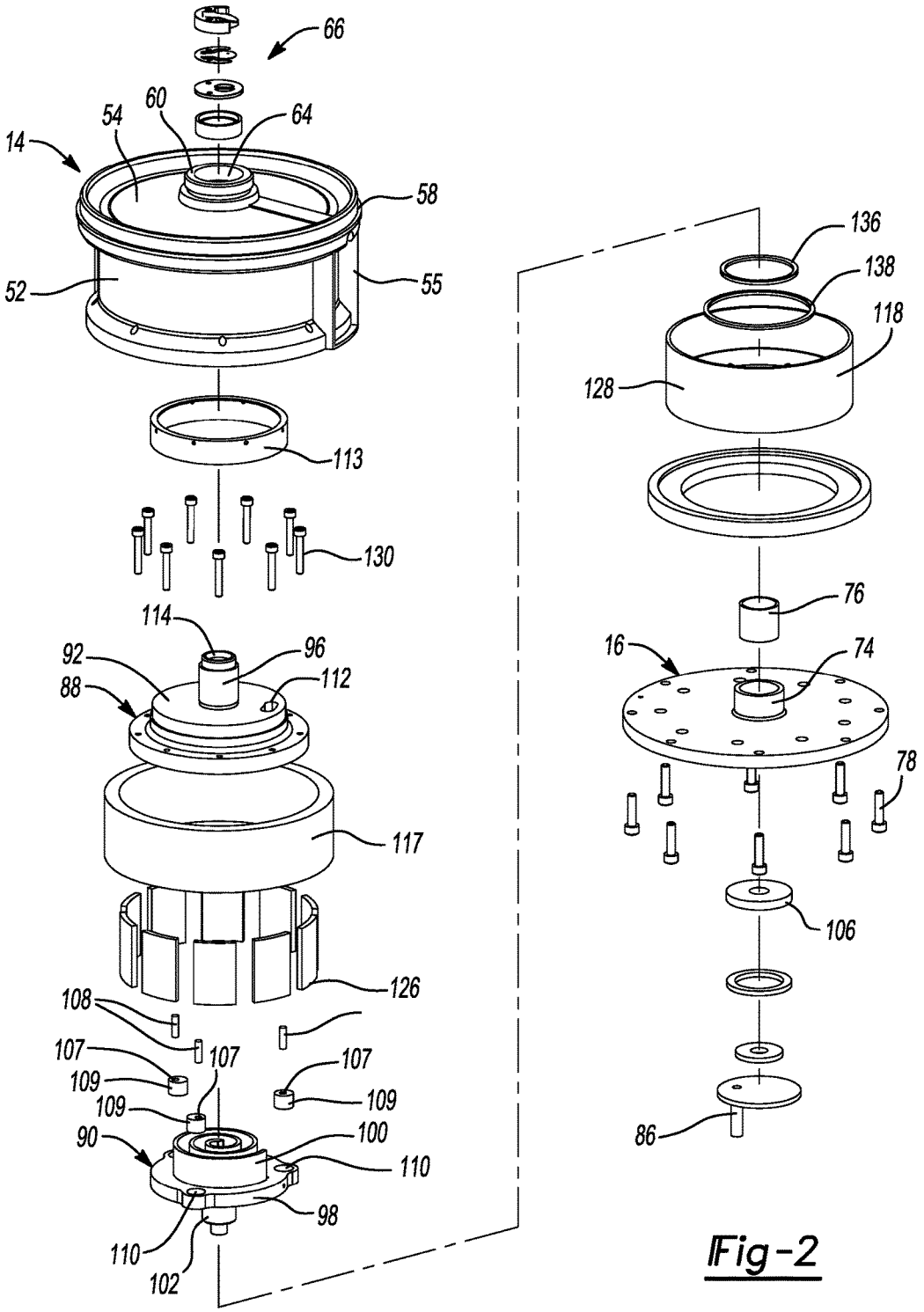
FIG. 2 is an exploded perspective view of a portion of the compressor of FIG. 1.

With reference to FIGS. 1 and 2, a compressor 10 is provided that may include a shell assembly 12, a first bearing housing 14, a second bearing housing 16, a first compression mechanism 18, a first motor assembly 20, a third bearing housing 21, a fourth bearing housing 23, a second compression mechanism 25, and a second motor assembly 27. The shell assembly 12 may include a first shell body 22, a second shell body 24, a third shell body 26, a fourth shell body 28, and a partition 30. The first and second shell bodies 22, 24 may be fixed to the first bearing housing 14 and to each other (e.g., with the first shell body 22 stacked on top of the second shell body 24). The second shell body 24, the first bearing housing 14 and the partition 30 may cooperate with each other to define a first suction chamber 32 in which the second bearing housing 16, the first compression mechanism 18 and the first motor assembly 20 may be disposed. A first suction inlet fitting 34 may engage the second shell body 24 and may be in fluid communication with the first suction chamber 32. Suction-pressure working fluid (i.e., low-pressure working fluid) may enter the first suction chamber 32 through the first suction inlet fitting 34 and may be drawn into the first compression mechanism 18 for compression therein. A first lubricant sump 42 may be disposed in the first suction chamber 32. That is, the second shell body 24 and the partition 30 may cooperate with each other to define the first lubricant sump 42.

The first shell body 22 and the first bearing housing 14 may cooperate with each other to define a first discharge chamber 36. The first bearing housing 14 may sealingly engage the first and second shell bodies 22, 24 to separate the first discharge chamber 36 from the first suction chamber 32. A first discharge outlet fitting 38 may engage the first shell body 22 and may be in fluid communication with the first discharge chamber 36. Discharge-pressure working fluid (i.e., working fluid at a higher pressure than suction pressure) may enter the first discharge chamber 36 from the first compression mechanism 18 and may exit the compressor 10 through the first discharge outlet fitting 38. In some configurations, a discharge valve 40 may be disposed within the first discharge outlet fitting 38. The discharge valve 40 may be a check valve that allows fluid to exit the first discharge chamber 36 through the first discharge outlet fitting 38 and prevents fluid from entering the first discharge chamber 36 through the first discharge outlet fitting 38.

The third and fourth shell bodies 26, 28 may be fixed to the third bearing housing 21 and to each other (e.g., with the third shell body 26 stacked on top of the fourth shell body 28). The fourth shell body 28 may include feet (or mounting flanges) 31 and may define a base of the shell assembly 12. The fourth shell body 28 and the third bearing housing 21 may cooperate with each other to define a second suction chamber 44 in which the fourth bearing housing 23, the second compression mechanism 25 and the second motor assembly 27 may be disposed. A second suction inlet fitting 46 may engage the fourth shell body 28 and may be in fluid communication with the second suction chamber 44. Suction-pressure working fluid (i.e., low-pressure working fluid) may enter the second suction chamber 44 through the second suction inlet fitting 46 and may be drawn into the second compression mechanism 25 for compression therein. A second lubricant sump 43 may be disposed in the second suction chamber 44. That is, the fourth shell body 28 defines the second lubricant sump 43.

The third shell body 26, the third bearing housing 21 and the partition 30 may cooperate with each other to define a second discharge chamber 48. The partition 30 separates the second discharge chamber 48 from the first suction chamber 32 such that the second discharge chamber 48 and the first suction chamber 32 are fluidly isolated from each other. The third bearing housing 21 may sealingly engage the third and fourth shell bodies 26, 28 to separate the second discharge chamber 48 from the second suction chamber 44. A second discharge outlet fitting 50 may engage the third shell body 26 and may be in fluid communication with the second discharge chamber 48. Discharge-pressure working fluid (i.e., working fluid at a higher pressure than suction pressure) may enter the second discharge chamber 48 from the second compression mechanism 25 and may exit the compressor 10 through the second discharge outlet fitting 50. In some configurations, a discharge valve 41 may be disposed within the second discharge outlet fitting 50. The discharge valve 41 may be a check valve that allows fluid to exit the second discharge chamber 48 through the second discharge outlet fitting 50 and prevents fluid from entering the second discharge chamber 48 through the second discharge outlet fitting 50.

The first bearing housing 14 may include a generally cylindrical annular wall 52 and a radially extending flange portion 54 disposed at an axial end of the annular wall 52. The annular wall 52 may include a suction baffle 55 (FIG. 2) and a suction passage 56 (FIG. 1) through which suction-pressure working fluid in the first suction chamber 32 can flow to the first compression mechanism 18. A portion of the suction passage 56 may extend radially through the flange portion 54 of the first bearing housing 14. The flange portion 54 may include an outer rim 58 that is welded to (or otherwise fixedly engages) the first and second shell bodies 22, 24. The flange portion 54 may include a central hub 60 that receives a first bearing 62. The central hub 60 may define a discharge passage 64 through which discharge-pressure working fluid flows from the first compression mechanism 18 to the first discharge chamber 36. A discharge valve assembly 66 (e.g., a check valve) may be disposed within the discharge passage 64 and may allow fluid flow from the first compression mechanism 18 to the first discharge chamber 36 and prevent fluid flow from the first discharge chamber 36 to the first compression mechanism 18.

The first bearing housing 14 may include an axially extending lubricant passage 68 that extends through the annular wall 52 and the flange portion 54 and is in fluid communication with the first lubricant sump 42. The flange portion 54 may also include a first radially extending lubricant passage 70 that is in fluid communication with the axially extending lubricant passage 68 and an aperture 72 that extends through the first bearing 62. Lubricant may flow from the axially extending lubricant passage 68 to the first radially extending lubricant passage 70 and the aperture 72.

The second bearing housing 16 may be a generally disk-shaped member having a central hub 74 that receives a second bearing 76. The second bearing housing 16 may be fixedly attached to an axial end of the annular wall 52 of the first bearing housing 14 via a plurality of fasteners 78, for example. The second bearing housing 16 may include a second radially extending lubricant passage 80 that is in fluid communication with the axially extending lubricant passage 68 in the first bearing housing 14 and an aperture 82 that extends through the second bearing 76. A lubricant pump 84 may be mounted to the second bearing housing 16 at or adjacent to the central hub 74 that may draw lubricant from the first lubricant sump 42 through lubricant conduit 86 and pump the lubricant through the aperture 82, through the second radially extending passage 80, through the axially extending lubricant passage 68, through the first radially extending lubricant passage 70 and through the aperture 72 in the first bearing 62.

The first compression mechanism 18 may include a first compression member and a second compression member that cooperate to define fluid pockets (i.e., compression pockets) therebetween. For example, the first compression mechanism 18 may be a co-rotating scroll compression mechanism in which the first compression member is a first scroll member (i.e., a driven scroll member) 88 and the second compression member is a second scroll member (i.e., an idler scroll member) 90. In other configurations, the compression mechanism 18 could be another type of compression mechanism, such as an orbiting scroll compression mechanism, a rotary compression mechanism, a screw compression mechanism, a Wankel compression mechanism or a reciprocating compression mechanism, for example.

The first scroll member 88 may include a first end plate 92, a first spiral wrap 94 extending from one side of the first end plate 92, and a first hub 96 extending from the opposite side of the first end plate 92. The second scroll member 90 may include a second end plate 98, a second spiral wrap 100 extending from one side of the second end plate 98, and a second hub 102 extending from the opposite side of the second end plate 98. The first hub 96 of the first scroll member 88 is received within the central hub 60 of the first bearing housing 14 and is supported by the first bearing housing 14 and the first bearing 62 for rotation about a first rotational axis A1 relative to the first and second bearing housings 14, 16. A seal 104 is disposed within the central hub 60 and sealing engages the central hub 60 and the first hub 96. The second hub 102 of the second scroll member 90 is received within the central hub 74 of the second bearing housing 16 and is supported by the second bearing housing 16 and the second bearing 76 for rotation about a second rotational axis A2 relative to the first and second bearing housings 14, 16. The second rotational axis A2 is parallel to first rotational axis A1 and is offset from the first rotational axis A1. A thrust bearing 106 may be disposed within the central hub 74 of the second bearing housing 16 and may support an axial end of the second hub 102 of the second scroll member 90.

The first and second spiral wraps 94, 100 are intermeshed with each other and cooperate to form a plurality of fluid pockets (i.e., compression pockets) therebetween. Rotation of the first scroll member 88 about the first rotational axis A1 and rotation of the second scroll member 90 about the second rotational axis A2 causes the fluid pockets to decrease in size as they move from a radially outer position to a radially inner position, thereby compressing the working fluid therein from the suction pressure to the discharge pressure.

The first end plate 92 may include a suction inlet opening 112 providing fluid communication between the suction passage 56 in the first bearing housing 14 and a radially outermost one of the fluid pockets defined by the spiral wraps 94, 100. An oil shroud 113 may be mounted on the first end plate 92 and may channel lubricant on the first end plate 92 into the suction inlet opening 112 to lubricate the first and second scroll members 88, 90. The first scroll member 88 also includes a discharge passage 114 that extends through the first end plate 92 and the first hub 96 and provides fluid communication between a radially innermost one of the fluid pockets and the first discharge chamber 36 (e.g., via the discharge passage 64). The second scroll member 90 may include a lubricant passage 116 that may extend through the second end plate 98 and the second hub 102. The lubricant passage 116 may be in fluid communication with the first lubricant sump 42 and the suction inlet opening 112.

In some configurations, the first compression mechanism 18 could include an Oldham coupling (not shown) that may be keyed to the first and second end plates 92, 98 or keyed to the second end plate 98 and a rotor 118 of the first motor assembly 20 to transmit motion of the first scroll member 88 to the second scroll member 90. In other configurations, the first compression mechanism 18 may include a transmission mechanism that includes a plurality of pins 108 (FIG. 2) attached to (e.g., by press fit) and extending axially from the first end plate 92 of first scroll member 88. Each of the pins 108 may be received with an off-center aperture 107 in a cylindrical disk 109 (FIG. 2; i.e., an eccentric aperture that extends parallel to and offset from a longitudinal axis of the cylindrical disk 109). The disks 109 may be rotatably received in a corresponding one of a plurality of recesses 110 (FIG. 2) formed in the second end plate 98 of the second scroll member 90. The recesses 110 may be positioned such that they are angularly spaced apart from each other in a circular pattern that surrounds the second rotational axis A2. In some configurations, the pins 108 could extend from a rotor 118 of the first motor assembly 20, rather than from the first scroll member 88.

The first motor assembly 20 may be a ring-motor and may include a composite stator 117 and the rotor 118. The stator 117 may be an annular member fixed to an inner diametrical surface 101 of the annular wall 52 of the first bearing housing 14. The stator 117 may surround the first and second end plates 92, 98 and the first and second spiral wraps 94, 100.

The rotor 118 may be disposed radially inside of the stator 117 and is rotatable relative to the stator 117. The rotor 118 may include an annular axially extending portion 120 that extends parallel to the first rotational axis A1 and a radially extending portion 122 that extends radially inward (i.e., perpendicular to the first rotational axis A1) from an axial end of the axially extending portion 120. The axially extending portion 120 may surround the first and second end plates 92, 98 and the first and second spiral wraps 94, 100. An inner diametrical surface 124 of the axially extending portion 120 may engage an outer periphery of the first end plate 92. Magnets 126 may be fixed to an outer diametrical surface 128 of the axially extending portion 120. Fasteners 130 may engage the radially extending portion 122 and the first end plate 92 to rotationally and axially fix the rotor 118 to the first scroll member 88. Therefore, when electrical current is provided to the stator 117, the rotor 118 and the first scroll member 88 rotate about the first rotational axis A1. Such rotation of the first scroll member 88 causes corresponding rotation of the second scroll member 90 about the second rotational axis A2 due to the engagement of the pins 108 and disks 109 within the recesses 110 in the second scroll member 90.

The radially extending portion 122 of the rotor 118 may include a central aperture 132 through which the second hub 102 of the second scroll member 90 extends. The radially extending portion 122 may also include an annular recess 134 that surrounds the central aperture 132 and the first and second rotational axes A1, A2. A first annular seal 136 and a second annular seal 138 may be at least partially received in the recess 134 and may sealingly engage the radially extending portion 122 and the second end plate 98. The second annular seal 138 may surround the first annular seal 136. In this manner, the first and second annular seals 136, 138, the second end plate 98 and the radially extending portion 122 cooperate to define an annular chamber 140. The annular chamber 140 may receive intermediate-pressure working fluid (at a pressure greater than suction pressure and less than discharge pressure) from an intermediate fluid pocket 142 via a passage 144 in the second end plate 98. Intermediate-pressure working fluid in the annular chamber 140 biases the second end plate 98 in an axial direction (i.e., a direction parallel to the rotational axes A1, A2) toward the first end plate 92 to improve the seal between tips of the first spiral wrap 94 and the second end plate 98 and the seal between tips of the second spiral wrap 100 and the first end plate 92.

The structure and function of the third bearing housing 21 may be similar or identical to that of the first bearing housing 14 described above, and therefore, will not be described again. The structure and function of the fourth bearing housing 23 may be similar or identical to that of the second bearing housing 16 described above, and therefore, will not be described again. The structure and function of the second compression mechanism 25 may be similar or identical to that of the first compression mechanism 18 described above, and therefore, will not be described again. The structure and function of the second motor assembly 27 may be similar or identical to that of the first motor assembly 20 described above, and therefore, will not be described again.

The configuration of the compressor 10 described above allows two independently operable compression mechanisms 18, 25 and two independently operable motor assemblies 20, 27 to be packaged within the single shell assembly 12. In particular, the structure of the bearing housings 14, 16, 21, 23, the motor assemblies 20, 27 and the compression mechanisms 18, 25 allows for the multiple, independently operable compression mechanisms and motor assemblies to be packaged within a single shell assembly while maintaining a reasonably compact overall size of the compressor 10. Furthermore, the configuration of the compressor 10 described above allows the compression mechanisms 18, 25 to be incorporated into a system in which the compression mechanism 18 compresses one type of refrigerant and the compressor mechanism 25 compresses a different type of refrigerant.

The compression mechanisms 18, 25 may have the same capacities or different capacities. Both of the motor assemblies 20, 27 may be fixed-speed motors, both of the motor assemblies 20, 27 may be variable-speed motors, or one of the motor assemblies 20, 27 may be a fixed-speed motor and the other of the motor assemblies 20, 27 may be a variable-speed motor. Furthermore, in some configurations, one or both of the compression mechanisms 18, 25 can be equipped with capacity modulation means (e.g., vapor injection, modulated suction valves, variable-volume ratio vales, etc.).

Figure 3:
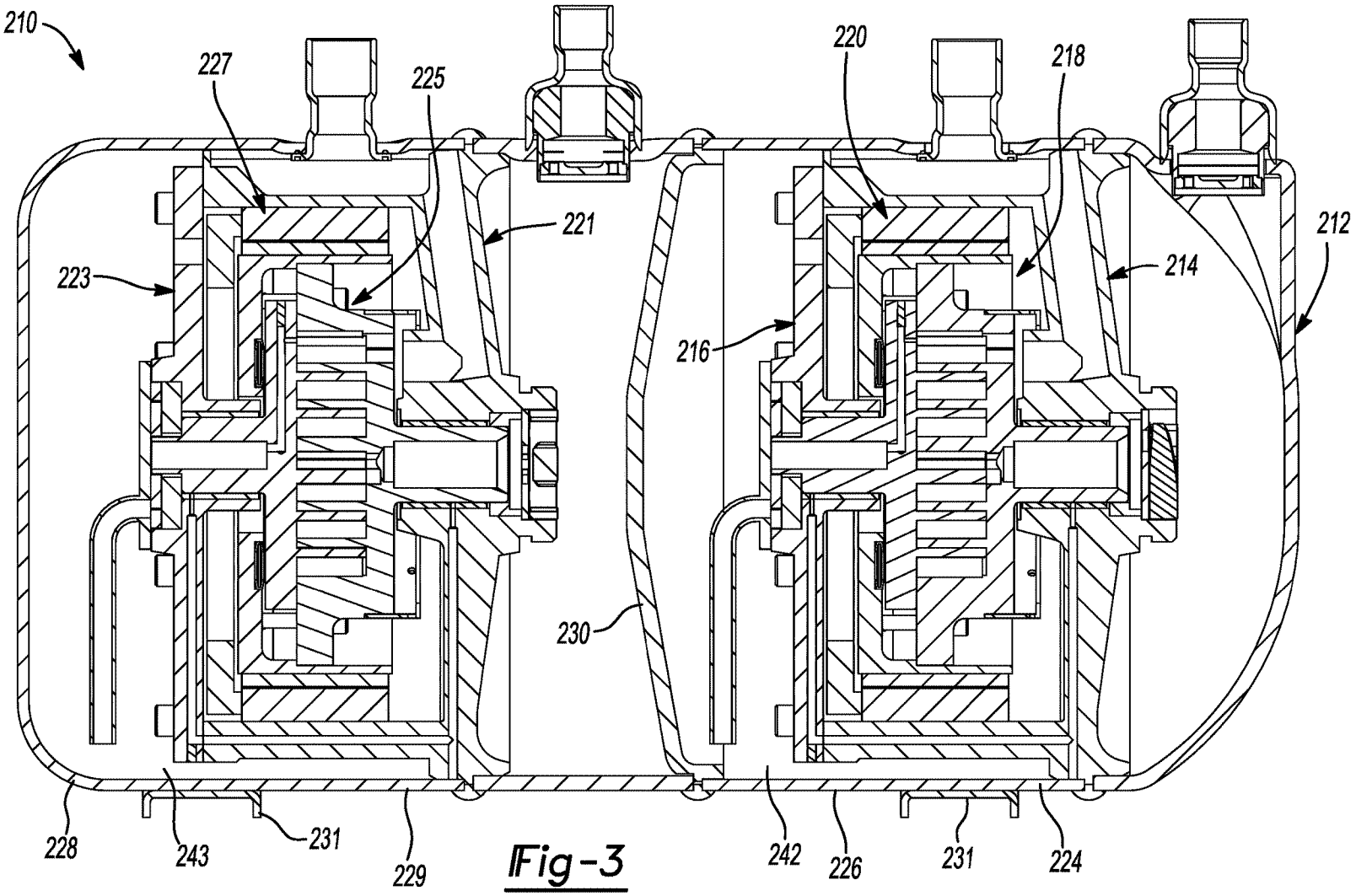
FIG. 3 is a cross-sectional view of another compressor according to the principles of the present disclosure.

With reference to FIG. 3, another compressor 210 is provided. The structure and function of the compressor 210 may be similar or identical to that of the compressor 10 described above, apart from any exceptions described below and/or shown in the figures. Therefore, similar features will not be described again in detail. Briefly, the compressor 210 may include a shell assembly 212, a first bearing housing 214, a second bearing housing 216, a first compression mechanism 218, a first motor assembly 220, a third bearing housing 221, a fourth bearing housing 223, a second compression mechanism 225, and a second motor assembly 227.

The compressor 210 is a horizontal compressor (unlike the compressor 10, which is a vertical compressor). That is, the compressor 210 is oriented such that a longitudinal axis of the shell assembly 212 is horizontally oriented (i.e., perpendicular to the direction of gravitational pull) and the rotational axes about which scroll members of the compression mechanisms 218, 225 rotate are horizontally oriented. The shell assembly 212 may be similar or identical to the shell assembly 12 described above, except feet (or mounting flanges) 231 may be attached to outer walls of cylindrical portions 226, 229 of shell bodies 224, 228 of the shell assembly 212. Furthermore, an inner wall of the cylindrical portion 226 may cooperate with the first bearing housing 214 and a partition 230 to define a first lubricant sump 242 that provides lubricant to the first compression mechanism 218 and the first motor assembly 220. An inner wall of the cylindrical portion 229 may cooperate with the third bearing housing 221 to define a second lubricant sump 243 that provides lubricant to the second compression mechanism 225 and the second motor assembly 227.

While the compressors 10, 210 shown in the figures and described above include two compression mechanisms and two motor assemblies, it will be appreciated that the compressors 10, 210 could have more than two compression mechanisms and more than two motor assemblies packaged with a single shell assembly.

Figure 4:
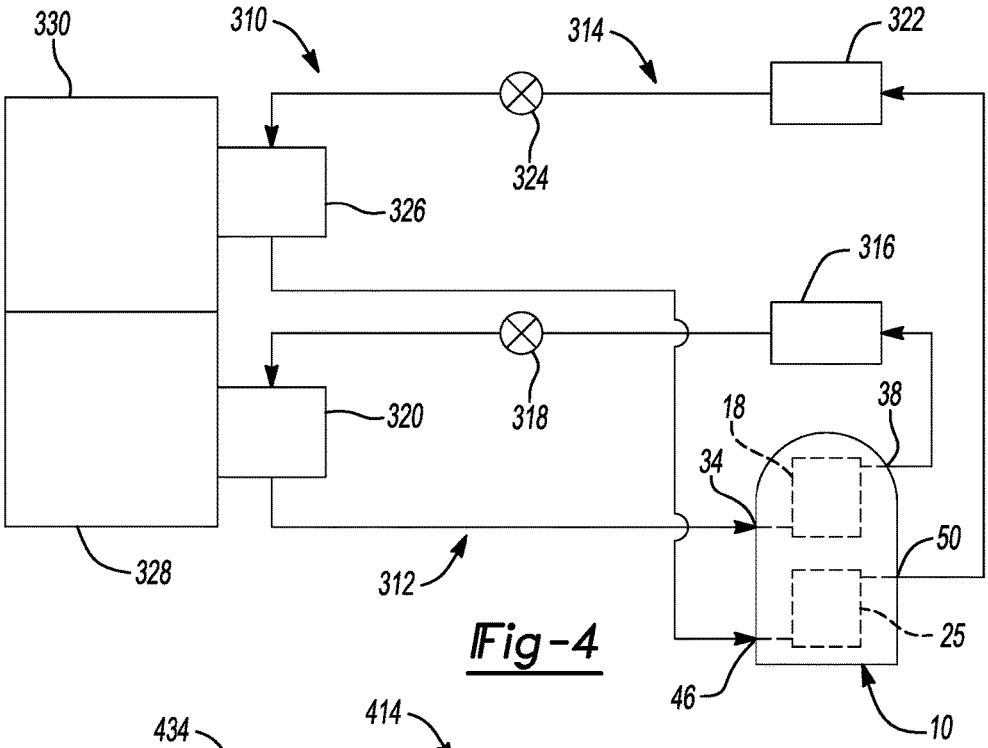
FIG. 4 is a schematic representation of a climate-control system according to the principles of the present disclosure.

With reference to FIG. 4, a system 310 is provided that may include the compressor 10 described above (or the compressor 210 described above), a first vapor-compression circuit 312, and a second vapor-compression circuit 314. The first and second vapor-compression circuits 312, 314 may be fluidly isolated from each other (i.e., working fluid does not transferred from one circuit 312, 314 to the other circuit 312, 314).

The first vapor-compression circuit 312 may include the first compression mechanism 18 of the compressor 10, a first outdoor heat exchanger 316 (e.g., a condenser or gas cooler), a first expansion device 318 (e.g., an expansion valve or capillary tube), and a first indoor heat exchanger 320 (e.g., an evaporator). The first compression mechanism 18 may receive suction-pressure working fluid from the first suction inlet fitting 34 of the compressor 10 and may compress the working fluid to a discharge pressure. The discharge-pressure working fluid may exit the compressor 10 through the first discharge outlet fitting 38 and may flow to the first outdoor heat exchanger 316, where the working fluid is cooled. Condensed working fluid may flow from the first outdoor heat exchanger 316 to the first expansion device 318, where the pressure of the working fluid is lowered. From the first expansion device 318, the working fluid may flow to the first indoor heat exchanger 320. The working fluid flowing through the first indoor heat exchanger 320 may absorb heat from a first space 328 (e.g., one or more rooms of a house or building, one or more compartments of a refrigerator or refrigeration case, one or more cargo compartments of a vehicle, etc.).

The second vapor-compression circuit 314 may include the second compression mechanism 25 of the compressor 10, a second outdoor heat exchanger 322 (e.g., a condenser or gas cooler), a second expansion device 324 (e.g., an expansion valve or capillary tube), and a second indoor heat exchanger 326 (e.g., an evaporator). The second compression mechanism 25 may receive suction-pressure working fluid from the second suction inlet fitting 46 of the compressor 10 and may compress the working fluid to a discharge pressure. The discharge-pressure working fluid may exit the compressor 10 through the second discharge outlet fitting 50 and may flow to the second outdoor heat exchanger 322, where the working fluid is cooled. Condensed working fluid may flow from the second outdoor heat exchanger 322 to the second expansion device 324, where the pressure of the working fluid is lowered. From the second expansion device 324, the working fluid may flow to the second indoor heat exchanger 326. The working fluid flowing through the second indoor heat exchanger 326 may absorb heat from a second space 330 (e.g., one or more rooms of a house or building, one or more compartments of a refrigerator or refrigeration case, one or more cargo compartments of a vehicle or transportation container, etc.).

The first and second spaces 328, 330 may be or include different rooms or areas of the same house or building, different compartments of the same refrigerator or refrigeration case (e.g., one of the spaces 328, 330 could be a refrigerated compartment and the other of the spaces 328, 330 could be a freezer compartment), or different cargo compartments (e.g., refrigerator and/or freezer compartments) of the same vehicle or transportation container. Since the compression mechanisms 18, 25 are operable independently of each other and may be operable at different capacities, each compression mechanism 18, 25 can be operated to achieve a desired level of cooling for the corresponding space 328, 330.

Figure 5:
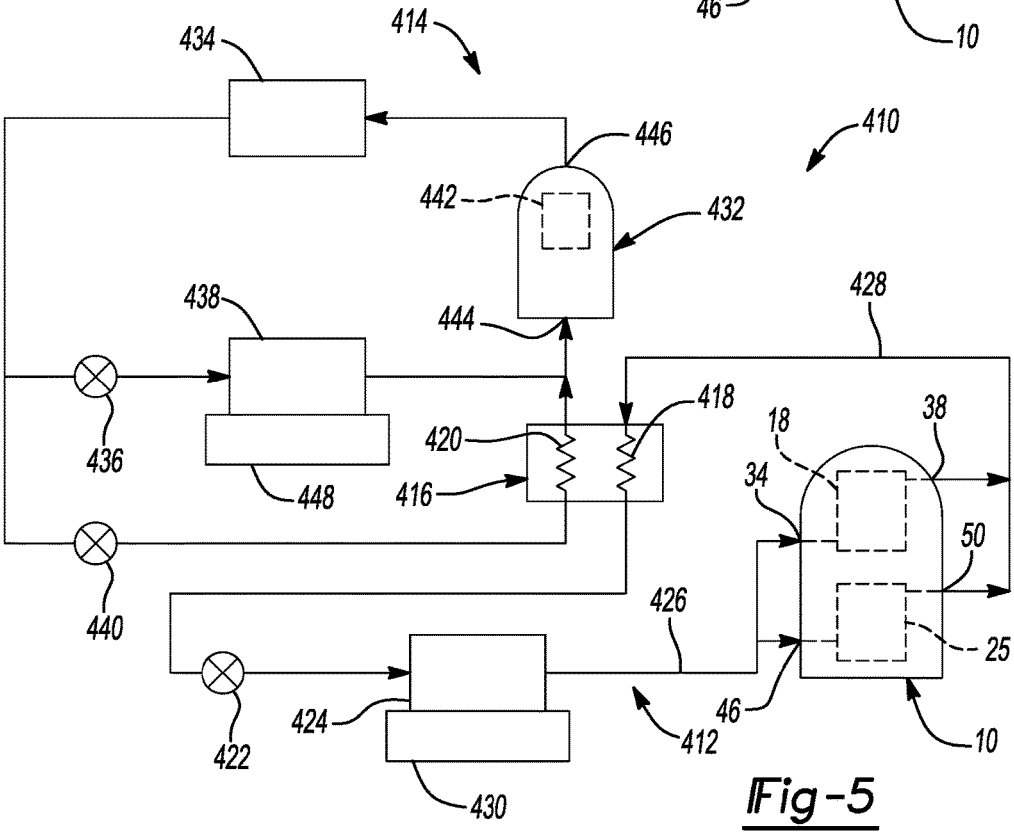
FIG. 5 is a schematic representation of another climate-control system according to the principles of the present disclosure.

With reference to FIG. 5, another system 410 is provided that may include a first vapor-compression circuit 412, a second vapor-compression circuit 414, and a dual-path heat exchanger 416 having a first fluid path 418 and a second fluid path 420. The first and second vapor-compression circuits 412, 414 may be fluidly isolated from each other (i.e., working fluid does not transferred from one circuit 412, 414 to the other circuit 412, 414).

The first vapor-compression circuit 412 may include the compressor 10 (or the compressor 210), the first fluid path 418 of the dual-path heat exchanger 416, a first expansion device 422 (e.g., an expansion valve or a capillary tube), and a first indoor heat exchanger 424. The first and second suction inlet fittings 34, 46 of the compressor 10 may both be in fluid communication with a suction line 426. The first and second discharge outlet fittings 38, 50 of the compressor 10 may both be in fluid communication with a discharge line 428.

The first and second compression mechanisms 18, 25 may receive suction-pressure working fluid from the first and second suction inlet fittings 34, 46, respectively, and may compress the working fluid. The compressed working fluid from the first and second compression mechanisms 18, 25 may exit the compressor 10 through the first and second discharge outlet fittings 38, 50, respectively, and may flow to the first fluid path 418 of the dual-path heat exchanger 416 through the discharge line 428. The working fluid may be cooled in the first fluid path 418 and may flow from the first fluid path 418 to the first expansion device 422, where the pressure of the working fluid is lowered. From the first expansion device 422, the working fluid may flow to the first indoor heat exchanger 424. The working fluid flowing through the first indoor heat exchanger 424 may absorb heat from a first space 430 (e.g., one or more rooms of a house or building, one or more compartments of a refrigerator or refrigeration case, one or more cargo compartments of a vehicle, etc.). From the first indoor heat exchanger 424, the working fluid may flow back to one or both of the suction inlet fittings 34, 46 through the suction line 426.

The second vapor-compression circuit 414 may include a second (secondary) compressor 432, an outdoor heat exchanger 434, a second expansion device 436, a second indoor heat exchanger 438, a third expansion device 440, and the second fluid path 420 of the dual-path heat exchanger 416. The second compressor 432 may include a third compression mechanism 442 (e.g., a scroll compression mechanism, a rotary compression mechanism, a reciprocating compression mechanism, a screw compression mechanism, etc.) that may receive suction-pressure working fluid from a third suction inlet fitting 444 and may compress the working fluid. The compressed working fluid from the third compression mechanism 442 may exit the second compressor 432 through a third discharge outlet fitting 446 and may flow to the outdoor heat exchanger 434, where the working fluid may be cooled.

A first portion of the working fluid that exits the outdoor heat exchanger 434 may flow to the second expansion device 436, where the pressure of the working fluid is lowered. From the second expansion device 436, the working fluid may flow to the second indoor heat exchanger 438. The working fluid flowing through the second indoor heat exchanger 438 may absorb heat from a second space 448 (e.g., one or more rooms of a house or building, one or more compartments of a refrigerator or refrigeration case, one or more cargo compartments of a vehicle, etc.). From the second indoor heat exchanger 438, the working fluid may flow back to the third suction inlet fitting 444.

A second portion of the working fluid that exits the outdoor heat exchanger 434 may bypass the second expansion device 436 and the second indoor heat exchanger 438 and may flow to the third expansion device 440, where the pressure of the working fluid is lowered. From the third expansion device 440, the working fluid may flow to the second fluid path 420 of the dual-path heat exchanger 416. Working fluid flowing through the second fluid path 420 may absorb heat from the working fluid flowing through the first fluid path 418. From the second fluid path 420, the working fluid may flow back to the third suction inlet fitting 444.

As described above, the first and second spaces 430, 448 may be or include different rooms or areas of the same house or building, different compartments of the same refrigerator or refrigeration case (e.g., one of the spaces 430, 448 could be a refrigerated compartment and the other of the spaces 430, 448 could be a freezer compartment), or different cargo compartments (e.g., refrigerator and/or freezer compartments) of the same vehicle or transportation container. Since the compression mechanisms 18, 25, 442 are operable independently of each other and may be operable at different capacities, operation of each compression mechanism 18, 25, 442 can be adjusted to achieve a desired level of cooling for the corresponding space 430, 448. Furthermore, the second and third expansion devices 436, 440 can be selectively opened or closed to adjust an amount of working fluid from the outdoor heat exchanger 434 that flows to the second indoor heat exchanger 438 and an amount of working fluid from the outdoor heat exchanger 434 that flows to the second fluid path 420. Adjusting the amounts of fluid flow through the second and third expansion devices 436, 440 can further adjust the cooling capacity at the first and second indoor heat exchangers 424, 438.

Figure 6:
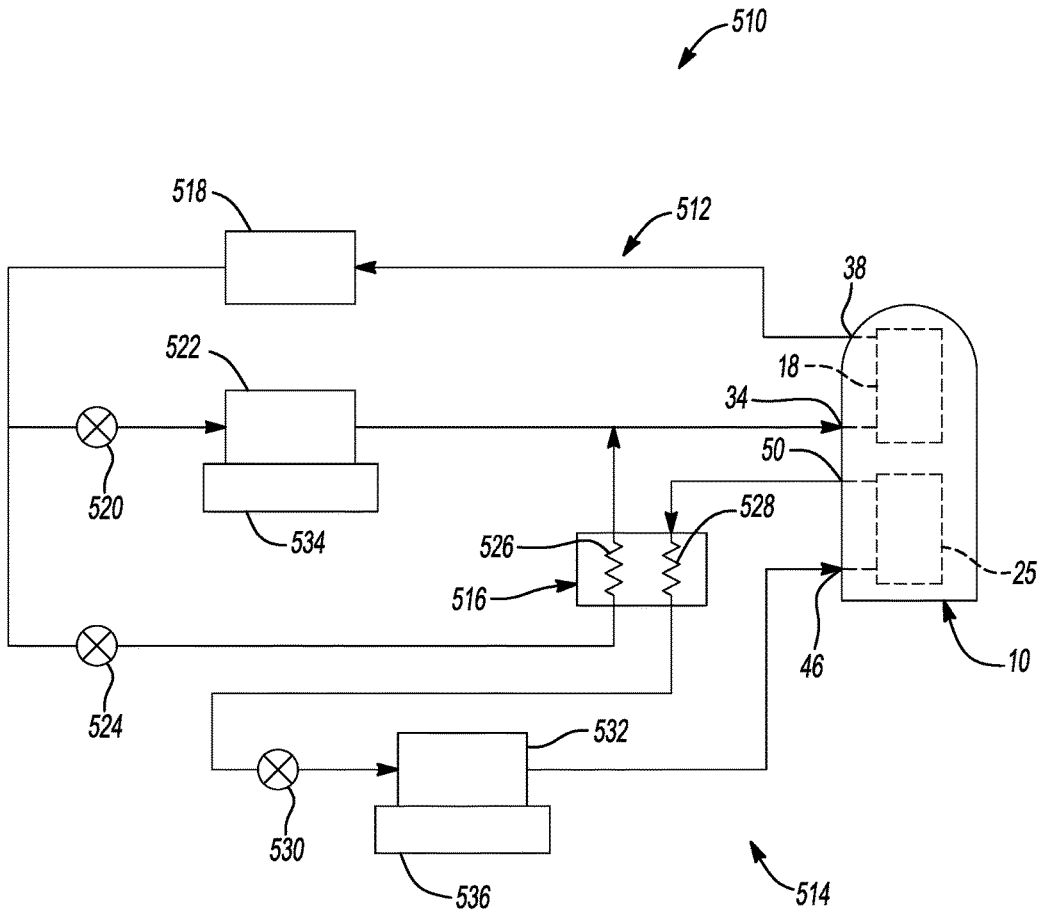
FIG. 6 is a schematic representation of yet another climate-control system according to the principles of the present disclosure.

With reference to FIG. 6, another system 510 is provided that may include the compressor 10 (or the compressor 210), a first vapor-compression circuit 512, a second vapor-compression circuit 514, and a dual-path heat exchanger 516. The first and second vapor-compression circuits 512, 514 may be fluidly isolated from each other (i.e., working fluid does not transferred from one circuit 512, 514 to the other circuit 512, 514).

The first vapor-compression circuit 512 may include the first compression mechanism 18 of the compressor 10, an outdoor heat exchanger 518, a first expansion device 520, a first indoor heat exchanger 522, a second expansion device 524, and a first fluid path 526 of the dual-path heat exchanger 516. The second vapor-compression circuit 514 may include the second compression mechanism 25 of the compressor 10, a second fluid path 528 of the dual-path heat exchanger 516, a third expansion device 530, and a second indoor heat exchanger 532.

The first compression mechanism 18 may receive suction-pressure working fluid from the first suction inlet fitting 34 and may compress the working fluid. The compressed working fluid from the first compression mechanism 18 may exit the compressor 10 through the first discharge outlet fitting 38 and may flow to the outdoor heat exchanger 518, where the working fluid may be cooled.

A first portion of the working fluid that exits the outdoor heat exchanger 518 may flow to the first expansion device 520, where the pressure of the working fluid is lowered. From the first expansion device 520, the working fluid may flow to the first indoor heat exchanger 522. The working fluid flowing through the first indoor heat exchanger 522 may absorb heat from a first space 534 (e.g., one or more rooms of a house or building, one or more compartments of a refrigerator or refrigeration case, one or more cargo compartments of a vehicle, etc.). From the first indoor heat exchanger 522, the working fluid may flow back to the first suction inlet fitting 34.

A second portion of the working fluid that exits the outdoor heat exchanger 518 may bypass the first expansion device 520 and the first indoor heat exchanger 522 and may flow to the second expansion device 524, where the pressure of the working fluid is lowered. From the second expansion device 524, the working fluid may flow to the first fluid path 526 of the dual-path heat exchanger 516. Working fluid flowing through the first fluid path 526 may absorb heat from working fluid flowing through the second fluid path 528. From the first fluid path 526, the working fluid may flow back to the first suction inlet fitting 34.

The second compression mechanism 25 may receive suction-pressure working fluid from the second suction inlet fitting 46 and may compress the working fluid. The compressed working fluid from the second compression mechanism 25 may exit the compressor 10 through the second discharge outlet fitting 50 and may flow to the second fluid path 528 of the dual-path heat exchanger 516. The working fluid may be cooled in the second fluid path 528 and may flow from the second fluid path 528 to the third expansion device 530, where the pressure of the working fluid is lowered. From the third expansion device 530, the working fluid may flow to the second indoor heat exchanger 532. The working fluid flowing through the second indoor heat exchanger 532 may absorb heat from a second space 536 (e.g., one or more rooms of a house or building, one or more compartments of a refrigerator or refrigeration case, one or more cargo compartments of a vehicle, etc.). From the second indoor heat exchanger 532, the working fluid may flow back to the second suction inlet fitting 46.

As described above, the first and second spaces 534, 536 may be or include different rooms or areas of the same house or building, different compartments of the same refrigerator or refrigeration case (e.g., one of the spaces 534, 536 could be a refrigerated compartment and the other of the spaces 534, 536 could be a freezer compartment), or different cargo compartments (e.g., refrigerator and/or freezer compartments) of the same vehicle or transportation container. Since the compression mechanisms 18, 25 are operable independently of each other and may be operable at different capacities, operation of each compression mechanism 18, 25 can be adjusted to achieve a desired level of cooling for the corresponding space 534, 536. Furthermore, the first and second expansion devices 520, 524 can be selectively opened or closed to adjust an amount of working fluid from the outdoor heat exchanger 518 that flows to the first indoor heat exchanger 522 and an amount of working fluid from the outdoor heat exchanger 518 that flows to the first fluid path 526. Adjusting the amounts of fluid flow through the first and second expansion devices 520, 524 can further adjust the cooling capacity at the first and second indoor heat exchangers 522, 532.

It will be appreciated that any one or more of the vapor-compression circuits 312, 314, 412, 414, 512, 514 of the systems 310, 410, 510, could be heat pump systems that include a switching valve that can be selectively switched between first and second positions to switch between a cooling mode (in which working fluid flows through the vapor-compression circuit 312, 314, 412, 414, 512, 514 in a first direction to cool the space 328, 330, 430, 448, 534, 536) and a heating mode (in which working fluid flows through the vapor-compression circuit 312, 314, 412, 414, 512, 514 in a second direction to heat the space 328, 330, 430, 448, 534, 536).

In some configurations of the system 310, one of the vapor-compression circuits 312, 314 could operate in the cooling mode to cool one of the spaces 328, 330 while the other of the compression circuits 312, 314 is operating in the heating mode to heat the other one of the spaces 328, 330. Therefore, within the single compressor 10, one of the compression mechanisms 18, 25 may circulate working fluid through the corresponding vapor-compression circuit 312, 314 in the cooling mode while the other one of the compression mechanisms 18, 25 is circulating working fluid through the other one of the vapor-compression circuits 312, 314 in the heating mode.

Similarly, in some configurations of the system 410, one of the vapor-compression circuits 412, 414 could operate in the cooling mode to cool one of the spaces 430, 448 while the other of the compression circuits 412, 414 is operating in the heating mode to heat the other one of the spaces 430, 448. Therefore, one of the compressors 10, 432 may circulate working fluid through the corresponding vapor-compression circuit 412, 414 in the cooling mode while the other one of the compressors 10, 432 is circulating working fluid through the other one of the vapor-compression circuits 412, 414 in the heating mode.

Similarly, in some configurations of the system 510, one of the vapor-compression circuits 512, 514 could operate in the cooling mode to cool one of the spaces 534, 536 while the other of the compression circuits 512, 514 is operating in the heating mode to heat the other one of the spaces 534, 536. Therefore, within the single compressor 10, one of the compression mechanisms 18, 25 may circulate working fluid through the corresponding vapor-compression circuit 512, 514 in the cooling mode while the other one of the compression mechanisms 18, 25 is circulating working fluid through the other one of the vapor-compression circuits 512, 514 in the heating mode.

Use of the compressor 10 (or compressor 210) in the systems 310, 410, 510 may be advantageous for a number of reasons. For example, the compact size of the compressor 10 can reduce the overall footprint of the system 310, 410, 510 while providing flexibility and versatility in the manner in which the system 310, 410, 510 can be operated.

The entire disclosures of each of Applicant's commonly owned U.S. Patent Application Publication No. 2018/0223843, U.S. Patent Application Publication No. 2018/0223848, U.S. Patent Application Publication No. 2018/0223842, and U.S. Patent Application Publication No. 2018/0223849 are incorporated herein by reference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a first compression mechanism disposed within the shell;

a first motor assembly disposed within the shell and driving the first compression mechanism;

a second compression mechanism disposed within the shell;

a second motor assembly disposed within the shell and driving the second compression mechanism, wherein the first and second motor assemblies are operable independently of each other to operate the first and second compression mechanisms independently of each other, a first suction inlet fitting attached to the shell and providing fluid to the first compression mechanism;

a first discharge outlet fitting attached to the shell and receiving fluid compressed by the first compression mechanism;

a second suction inlet fitting attached to the shell and providing fluid to the second compression mechanism; and a second discharge outlet fitting attached to the shell and receiving fluid compressed by the second compression mechanism, wherein the shell includes a partition defining a first suction chamber and a second discharge chamber, wherein the first suction chamber receives fluid from the first suction inlet, and wherein the second discharge chamber receives fluid from said second compression mechanism and provides fluid to the second discharge outlet.

2. The compressor of claim 1, wherein the first compression mechanism includes a first scroll member that is rotatable relative to the shell about a first rotational axis and a second scroll member that is rotatable relative to the shell about a second rotational axis that is parallel to and offset from the first rotational axis, and wherein the second compression mechanism includes a third scroll member that is rotatable relative to the shell about a third rotational axis and a fourth scroll member that is rotatable relative to the shell about a fourth rotational axis that is parallel to and offset from the third rotational axis.

3. The compressor of claim 2, wherein the first motor assembly includes a first rotor attached to the first scroll member and surrounds the first and second scroll members, and wherein the second motor assembly includes a second rotor attached to the third scroll member and surrounds the third and fourth scroll members.

4. The compressor of claim 3, further comprising:

a first bearing housing disposed within the shell and rotatably supporting a first hub of the first scroll member, the first bearing housing cooperating with the shell to define a first discharge chamber that receives compressed fluid from the first compression mechanism and is in fluid communication with the first discharge outlet fitting;

a second bearing housing disposed within the first suction chamber and rotatably supporting a second hub of the second scroll member;

a third bearing housing disposed within the shell and rotatably supporting a third hub of the third scroll member, the third bearing housing cooperating with the partition to define the second discharge chamber, the third bearing housing defining a second suction chamber in fluid communication with the second suction inlet fitting; and a fourth bearing housing disposed within the second suction chamber and rotatably supporting a fourth hub of the fourth scroll member.

5. The compressor of claim 4, wherein the first suction chamber is fluidly isolated from the second suction chamber, and wherein the first discharge chamber is fluidly isolated from the second discharge chamber.

6. The compressor of claim 4, wherein the partition defines a first lubricant sump disposed within the first suction chamber and providing lubricant to the first compression mechanism, and wherein the shell defines a second lubricant sump disposed within the second suction chamber and providing lubricant to the second compression mechanism.

7. The compressor of claim 3, wherein the first and second rotors each include a radially extending portion that extends radially outward relative to the first rotational axis and an axially extending portion that extends parallel to the first rotational axis, wherein the axially extending portion of the first rotor engages the first scroll member and surrounds the second scroll member, and wherein the axially extending portion of the second rotor engages the third scroll member and surrounds the fourth scroll member.

8. The compressor of claim 7, further comprising a first seal engaging the second scroll member and the radially extending portion of the first rotor; and a second seal engaging the fourth scroll member and the radially extending portion of the second rotor.

9. The compressor of claim 1, wherein the partition defines a first lubricant sump that provides lubricant to the first compression mechanism.

10. A system including the compressor of claim 1, wherein the system further comprises:

a first indoor heat exchanger; and a first expansion device in fluid communication with the first indoor heat exchanger;

wherein the compressor circulates fluid between the first indoor heat exchanger and the first expansion device.

11. The system of claim 10, further comprising a first outdoor heat exchanger in fluid communication with the first expansion device, wherein the first compression mechanism circulates the fluid between the first indoor heat exchanger and the first outdoor heat exchanger.

12. The system of claim 11, further comprising a second indoor heat exchanger in fluid communication with the second compression mechanism, wherein the second indoor heat exchanger and the second compression mechanism are fluidly isolated from the first compression mechanism, the first outdoor heat exchanger, the first expansion device, and the first indoor heat exchanger.

13. The system of claim 12, further comprising a dual-path heat exchanger including a first fluid path disposed upstream of the first compression mechanism and a second fluid path disposed downstream of the second compression mechanism, wherein the first and second fluid paths are in a heat transfer relationship with each other and are fluidly isolated from each other.

14. The system of claim 12, further comprising:

a second outdoor heat exchanger in fluid communication with the second indoor heat exchanger; and a second expansion device in fluid communication with the second outdoor heat exchanger and the second indoor heat exchanger, wherein the second compression mechanism circulates fluid between the second indoor heat exchanger and the second outdoor heat exchanger.

15. The system of claim 10, further comprising:

a dual-path heat exchanger including a first fluid path and a second fluid path in a heat transfer relationship with each other and fluidly isolated from each other, the first fluid path in fluid communication with the first and second compression mechanisms, the first expansion device, and the first indoor heat exchanger;

an outdoor heat exchanger in fluid communication with the second fluid path;

a second indoor heat exchanger in fluid communication with the outdoor heat exchanger;

a second expansion device disposed between and in fluid communication with the outdoor heat exchanger and the second indoor heat exchanger;

a third expansion device disposed between and in fluid communication with the outdoor heat exchanger and the second fluid path; and a secondary compressor in fluid communication with the outdoor heat exchanger, the second indoor heat exchanger, and the second fluid path.

16. The system of claim 10, wherein the first compression mechanism includes a first scroll member that is rotatable relative to the shell about a first rotational axis and a second scroll member that is rotatable relative to the shell about a second rotational axis that is parallel to and offset from the first rotational axis, and wherein the second compression mechanism includes a third scroll member that is rotatable relative to the shell about a third rotational axis and a fourth scroll member that is rotatable relative to the shell about a fourth rotational axis that is parallel to and offset from the third rotational axis.

17. The system of claim 16, wherein the first motor assembly includes a first rotor attached to the first scroll member and surrounds the first and second scroll members, and wherein the second motor assembly includes a second rotor attached to the third scroll member and surrounds the third and fourth scroll members.

18. The system of claim 10, wherein the first suction inlet is fluidly isolated from the second suction inlet, and wherein the first discharge outlet is fluidly isolated from the second discharge outlet.

* * * * *